US009205680B2

(12) United States Patent
Mackey et al.

(10) Patent No.: US 9,205,680 B2
(45) Date of Patent: Dec. 8, 2015

(54) PRINTER HAVING REGENERATIVE INTERMEDIARY DRIVE

(71) Applicant: Memjet Technology Ltd., Dublin (IE)

(72) Inventors: Paul Ian Mackey, North Ryde (AU); David William Jensen, North Ryde (AU)

(73) Assignee: Memjet Technology Ltd. (IE)

( * ) Notice: Subject to any disclaimer, the term of this patent is extended or adjusted under 35 U.S.C. 154(b) by 0 days.

(21) Appl. No.: 14/559,000

(22) Filed: Dec. 3, 2014

(65) Prior Publication Data

US 2015/0197106 A1 Jul. 16, 2015

Related U.S. Application Data

(60) Provisional application No. 61/928,103, filed on Jan. 16, 2014.

(51) Int. Cl.

| | |
|---|---|
| ***B41J 11/04*** | (2006.01) |
| ***B41J 13/26*** | (2006.01) |
| ***B65H 3/06*** | (2006.01) |
| ***B65H 5/06*** | (2006.01) |
| ***B65H 9/16*** | (2006.01) |

(52) U.S. Cl.

CPC *B41J 11/04* (2013.01); *B41J 13/26* (2013.01); *B65H 3/0684* (2013.01); *B65H 5/062* (2013.01); *B65H 9/166* (2013.01); *B65H 2404/143* (2013.01); *B65H 2404/144* (2013.01); *B65H 2404/1521* (2013.01); *B65H 2404/6111* (2013.01); *B65H 2801/12* (2013.01)

(58) Field of Classification Search

CPC ..... B65H 2404/14211; B65H 3/0669

USPC ..... 347/104

See application file for complete search history.

(56) References Cited

U.S. PATENT DOCUMENTS

| | | | | |
|---|---|---|---|---|
| 4,659,419 | A * | 4/1987 | Miyake | 156/522 |
| 4,674,001 | A * | 6/1987 | Takahashi et al. | 360/137 |
| 5,253,862 | A * | 10/1993 | Acquaviva et al. | 271/251 |
| 5,735,518 | A * | 4/1998 | Takemoto et al. | 271/274 |
| 5,844,593 | A * | 12/1998 | Proffitt et al. | 347/262 |
| 6,113,509 | A * | 9/2000 | Downing | 474/86 |
| 6,749,298 | B1 * | 6/2004 | Schalk et al. | 347/104 |

(Continued)

FOREIGN PATENT DOCUMENTS

JP H07-69494 3/1995

OTHER PUBLICATIONS

International Search Report and Written Opinion for PCT/EP2014/079099 issued Aug. 7, 2015, 16 pages.

*Primary Examiner* — Stephen Meier
*Assistant Examiner* — John P Zimmermann
(74) *Attorney, Agent, or Firm* — Cooley LLP

(57) ABSTRACT

A printer includes: a media tray; a picker; a media guide for guiding the media sheets around a media feed path towards a print zone; a main drive roller assembly positioned upstream of the print zone; and an intermediary drive roller assembly positioned between the picker and the main drive roller assembly. The intermediary drive roller assembly includes: an intermediary idler roller mounted on an intermediary idler shaft; and an intermediary drive roller having a gripping surface engaged with the intermediary idler roller. An intermediary drive shaft is pivotally connected to a support shaft via a swing arm, such that the intermediary drive shaft is arcuately moveable relative to the intermediary idler shaft to provide a variable distance therebetween.

14 Claims, 7 Drawing Sheets

(56) References Cited

U.S. PATENT DOCUMENTS

| | | | | |
|---|---|---|---|---|
| 7,942,496 | B2 * | 5/2011 | Knight et al. | 347/29 |
| 8,469,358 | B1 | 6/2013 | Wen | |
| 2004/0207706 | A1 * | 10/2004 | Ohashi et al. | 347/104 |
| 2004/0251592 | A1 * | 12/2004 | Ruhe et al. | 271/109 |
| 2009/0236800 | A1 | 9/2009 | Buxton et al. | |
| 2009/0295067 | A1 | 12/2009 | Yanagishita | |

* cited by examiner

PRINTER HAVING REGENERATIVE INTERMEDIARY DRIVE

FIELD OF THE INVENTION

This invention relates to a media feed mechanism for a high-speed, sheet-fed printer. It has been developed primarily to minimize skew and simplify media handling in both simplex and duplex printing.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary pagewidth printhead offering the advantages of high-speed printing and noise reduction compared to conventional scanning inkjet printers.

In a typical media feed mechanism, a media sheet (e.g. paper) is picked from a media tray using a media picker, which typically comprises a rubberized roller. The sheet is fed around a C-chute and into the nip of a main drive roller assembly positioned upstream of the printhead. The drive roller assembly comprises a drive roller engaged with an idler roller, with the drive roller controlling the speed of the media as it travels through the print zone opposite the printhead. From the print zone, the media sheet is delivered to an output tray generally positioned above the media tray. One or more intermediary drive roller assemblies may be positioned between the picker and the main drive roller. The intermediary drive assists in guiding the media sheet around the C-chute and into the nip of the main drive roller assembly.

Media skew is potentially problematic in printers, especially high-speed printers. Potential sources of skew include, for example, picker alignment, media tray alignment to the printer, media alignment within the media tray, different drag forces on opposite side edges of the media, media stiffness variations etc. Any media skew as the media travel around the C-chute is transmitted into the print zone resulting in skewed printouts. Minor skew variations are barely noticeable to most users; however, skew variations become more noticeable in bound multi-page documents. Moreover, duplexed printing requires the same media sheet to pass through the print zone twice, so that any media skew on the first pass tends to be exacerbated on the second pass.

Media feed mechanisms also require accurate coordination between the various roller assemblies. Typically, a system of sensors is employed to monitor the position of the media sheet around the media path, and a controller uses feedback from the sensors to coordinate operation of the various rollers.

It would be desirable to simplify coordination of an intermediary drive roller assembly and a main drive roller assembly in a media feed mechanism for a printer. It would further be desirable to provide a media feed mechanism, which minimizes skew in media sheets as they pass through the print zone of a printer.

SUMMARY OF THE INVENTION

In a first aspect, there is provided a printer comprising:

a media tray for storing a plurality of media sheets;

a picker for picking individual media sheets from the media tray;

a media guide for guiding the media sheets around a media feed path towards a print zone;

a main drive roller assembly positioned upstream of the print zone; and an intermediary drive roller assembly positioned between the picker and the main drive roller assembly, the intermediary drive roller assembly comprising:

an intermediary idler roller mounted on an intermediary idler shaft; and an intermediary drive roller having a gripping surface engaged with the intermediary idler roller, the intermediary drive roller being mounted on a rotatable intermediary drive shaft, the intermediary drive shaft being operatively connected to a drive mechanism, wherein the intermediary drive shaft is pivotally connected to a support shaft via a swing arm, such that the intermediary drive shaft is arcuately moveable relative to the intermediary idler shaft to provide a variable distance therebetween.

The printer according to the first aspect advantageously facilitates hand-offs between the intermediary drive roller assembly ("intermediary drive") and the main drive roller assembly ("main drive") during use. The intermediary drive shaft is freely moveable relative to the intermediary idler shaft without any dedicated actuation device, such as a cam and/or biasing mechanism, for causing such movement. In particular, during media feeding through the intermediary drive, drag forces from the media sheets cause a reaction in the swing arm, which arcuately moves the intermediary drive shaft towards the intermediary drive shaft and provides a regenerative clamping force between the intermediary drive and idler rollers. The clamping force is regenerative, because it increases with greater drag forces from the media.

This regenerative clamping force enables hand-offs from the intermediary drive to the main drive to be self-coordinating without relying on complex sensor and feedback systems. Once the leading portion of a media sheet enters the nip of the main drive, and the main drive takes over media feeding, the tailing portion of the media sheet overruns the intermediary drive, negating the drag forces and causing the intermediary rollers to open passively via movement of the swing arm.

Furthermore, since the clamping force is regenerative, during use only a gripping load appropriate to paper drag is applied by the intermediary rollers for each media type. This arrangement therefore minimizes roller wear and minimizes flat spots in the intermediary rollers from extended idle periods. Furthermore, the intermediary drive is suitable for use with a range of different media having, for example, different thickness and/or stiffness.

Preferably, the printer further comprises a datum plate mounted perpendicularly with respect to the media feed path for engaging a side edge of each media sheet conveyed around the media guide. The datum plate provides side justification of the media sheets and reduces misalignments between printed sheets.

Preferably, the intermediary drive shaft, the intermediary idler shaft and the support shaft extend through respective openings in the datum plate. This arrangement enables the drive mechanism of the intermediary drive to be hidden behind a rear surface of the datum plate. The front surface of the datum plate is defined as the surface that contacts print media, while the opposite rear surface of the datum plate does not contact print media.

Preferably, the intermediary drive and idler rollers are both tilted relative to the datum plate in a media feed direction. This tilted intermediary drive and idler rollers cooperate with the datum plate to act as a de-skewing mechanism for de-skewing any skew in the media sheets passing through the intermediary drive. This skew is corrected downstream of the intermediary drive before the sheets enter the main drive.

Typically, the intermediary drive and idler rollers are both tilted towards the datum plate at a tilt angle of between 0.5 and 5 degrees, the tilt angle being defined as the angle between the datum plate and the drive direction of the rollers (i.e. the direction normal to the intermediary idler shaft). Preferably, the tilt angle is between 1 and 2 degrees. In particular, a tilt angle of about 1.5 degrees has been found to provide excellent de-skewing for a wide range of media, with minimal damage to side edges of media sheets as they engage and align with the datum plate. The regenerative clamping force of the intermediary drive facilitates de-skewing by providing only the minimal required gripping force in the nip defined between the intermediary drive and idler rollers. With this optimal gripping force, each media sheet is able to rotationally slip about its yaw axis so as to maneuver into an orientation aligned with the datum plate.

Preferably, the requisite tilt angle is provided by mounting the intermediary drive and idler shafts so that they extend non-perpendicularly relative to the datum plate.

Preferably, the datum plate extends across one side of the media feed path at least 8 cm, at least 10 cm, or at least 12 cm upstream and downstream of the intermediary drive and idler rollers (i.e. the datum plate may extend, for example, about 10 cm upstream and about 10 cm downstream of the nip defined between the intermediary drive and idler rollers). Typically, the datum plate extends from the media tray and may be contiguous with a datum plate incorporated into the media tray.

By extending the datum plate in each direction on either side of intermediary drive, the datum plate effectively provides lever arms which are long enough to react the skew alignment moments experienced by the media sheets as they travel through the intermediary drive. The extended datum plate also provides drag forces through engagement with the side edges of the media sheets. These drag forces, in combination with the frictional engagement of the media sheets on the intermediary drive roller, actuate the regenerative clamping mechanism of the intermediary drive during use.

Preferably, a first end of the intermediary drive shaft is received in a bearing, the bearing having a clearance allowing arcuate movement of an opposite second end of the intermediary drive shaft. In other words, the intermediary drive shaft is mounted so as to enable a variable distance between the intermediary drive shaft and the intermediary idler shaft.

Preferably, the swing arm pivotally interconnects the second end of the intermediary drive shaft and an end of the support shaft. The support shaft is typically fixed (i.e. non-rotatable).

Preferably, the support shaft and the intermediary idler shaft are parallel with each other and positioned on opposite sides of the intermediary drive shaft. Preferably, the support shaft is positioned upstream of the intermediary drive shaft relative to the media feed direction. This arrangement enables the intermediary drive shaft to narrow its distance from the intermediary idler shaft via arcuate movement when the swing arm experiences drag forces, which are generally opposed to the media feed direction. Hence, the clamping force between the intermediary drive and idler rollers is regenerative.

Preferably, the drive mechanism comprises a gear train operatively connecting the intermediary drive shaft to an intermediary drive motor.

Preferably, the gear train comprises first and second intermeshed gear wheels, the first gear wheel being coaxial with the support shaft and the second gear wheel being coaxial with the intermediary drive shaft. This dual coaxial arrangement advantageously minimizes any change in mesh depth between the first and second intermeshed gear wheels when the swing arm moves. Thus, the arcuate displacement of the intermediary drive shaft has a minimal effect on gear operation.

Preferably, a gear ratio of the second gear wheel to the first gear wheel is at least 2:1 or at least 3:1.

Preferably, the printer comprises a controller configured for operating the intermediary drive roller at a lower speed than the main drive roller. Preferably, the main drive gear assembly exerts a higher clamping (or gripping) force on media sheets than the intermediary drive roller assembly.

Preferably, the controller is configured for operating the intermediary drive roller at a higher speed than a picker roller of the picker.

Accordingly, once a media sheet is gripped by the main drive, the media sheet slips within the intermediary drive. This slippage ceases the regenerative clamping force of the intermediary drive and causes the intermediary drive roller to move away from the intermediary idler roller. This opening of the intermediary drive is passive without requiring any dedicated actuation device. Therefore, during use, the main and intermediary drives are typically self-coordinating in the sense that the opening and closing of the intermediary drive and idler rollers is entirely passive and responsive only to the position of the media sheet in the media feed path.

Preferably, the printer further comprises a duplexing guide loop, wherein the duplexing guide loop incorporates at least part of the media guide path. Preferably, the intermediary drive roller assembly is common to a simplex printing path and a duplex printing path.

Preferably, the duplexing guide loop is absent any dedicated duplexing drive rollers other than the intermediary drive roller.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
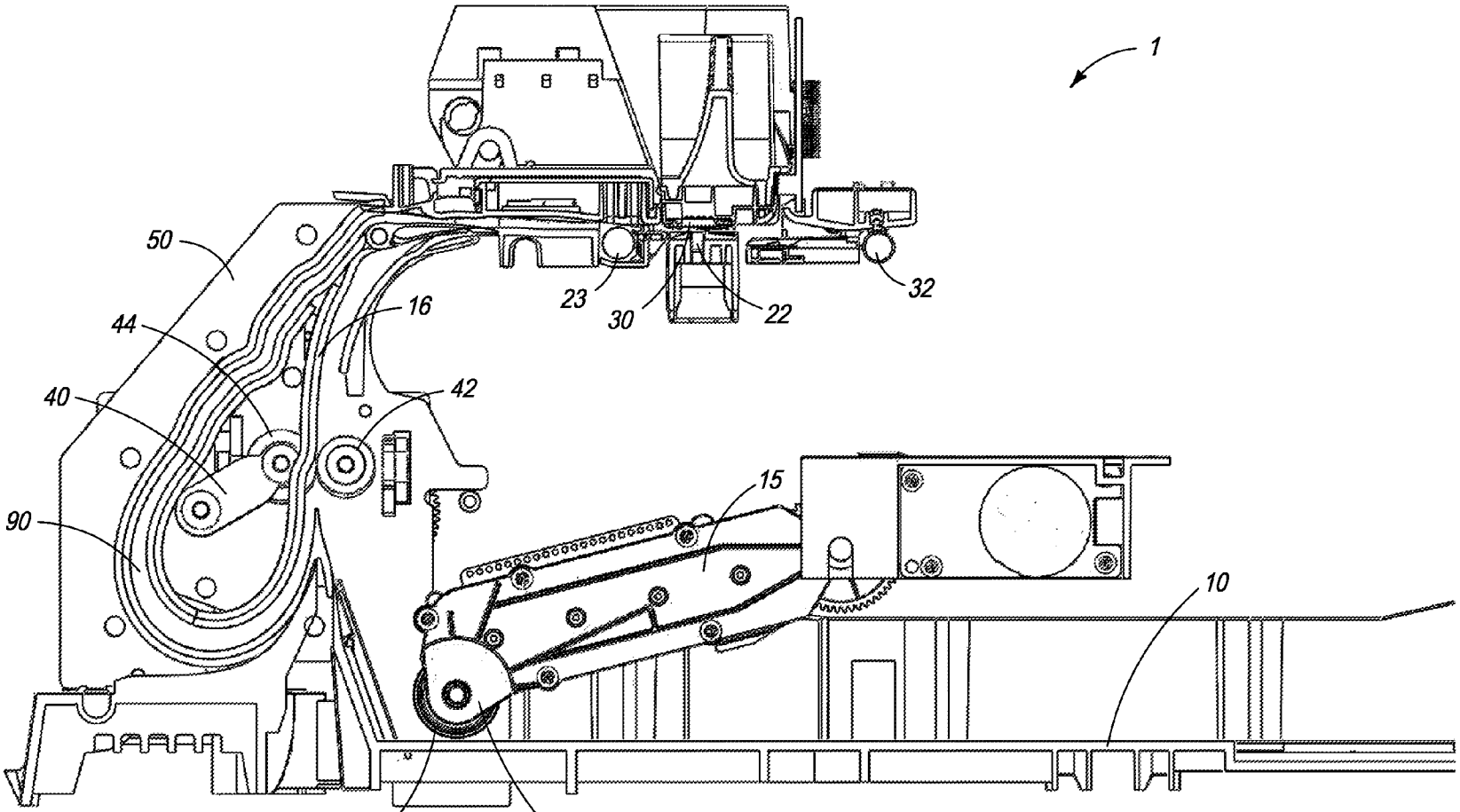
FIG. 1 is a schematic side view of a printer according to the first aspect.

Referring to FIG. 1, there is shown a printer 1 comprising a media tray 10 for storing a plurality of media sheets (e.g. paper) and a picker 12 for picking individual media sheets from the media tray. The picker 12 comprises a rubberized picker roller 13 rotatably mounted at one end of a picking arm 15, as is known in conventional inkjet and laser printers. A media guide 16 extends generally from a picking zone of the printer towards a main drive roller 23 positioned upstream of a print zone 22. For simplex printing, the media guide 16 guides the media sheets around a generally C-shaped path and delivers each sheet into a nip of the main drive roller 23 positioned above the media tray 10. The media guide 16 comprises one or more guide surfaces having an optimal profile for smooth transport of the media sheets around a curved path with minimal risk of paper-jamming.

A main driver roller assembly comprises the main drive roller 23 engaged with a main idler roller (not shown) for delivery of media sheets into the print zone 22 at a predetermined velocity. The predetermined velocity of media sheets in the print zone 22 is controlled solely by the rotational speed of the main drive roller 23. The print zone 22 is downstream of the main drive roller 23 and is defined by an area opposite a printhead 30. Typically, the printhead 30 is a pagewidth inkjet printhead, although it will be appreciated that the present invention is equally applicable to other types of printhead and, indeed, other types of printer. From the print zone 22, the media sheets are delivered into the nip of an output roller assembly 32 and thence, in the case of simplex printing, into a media output tray (not shown).

Figure 2:
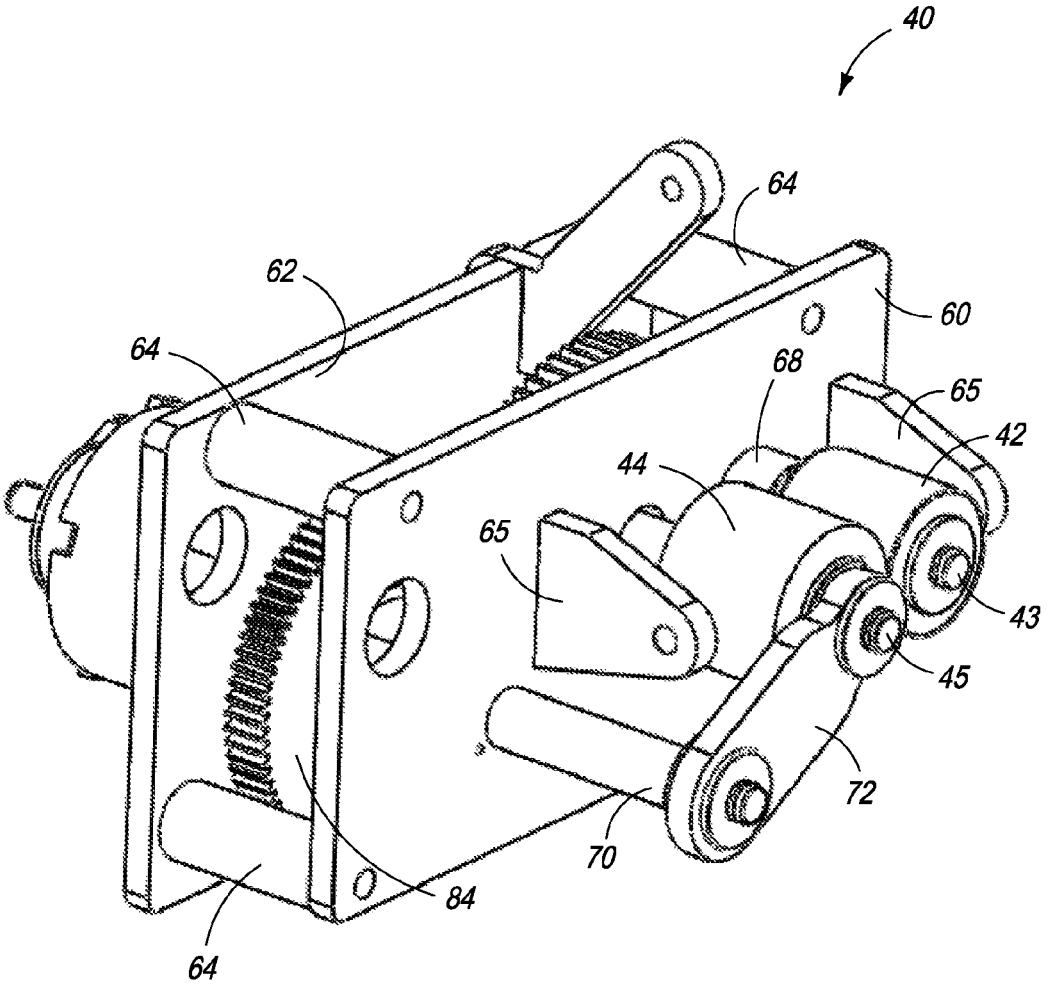
FIG. 2 is a top perspective view of an intermediary drive in isolation.
Figure 3:
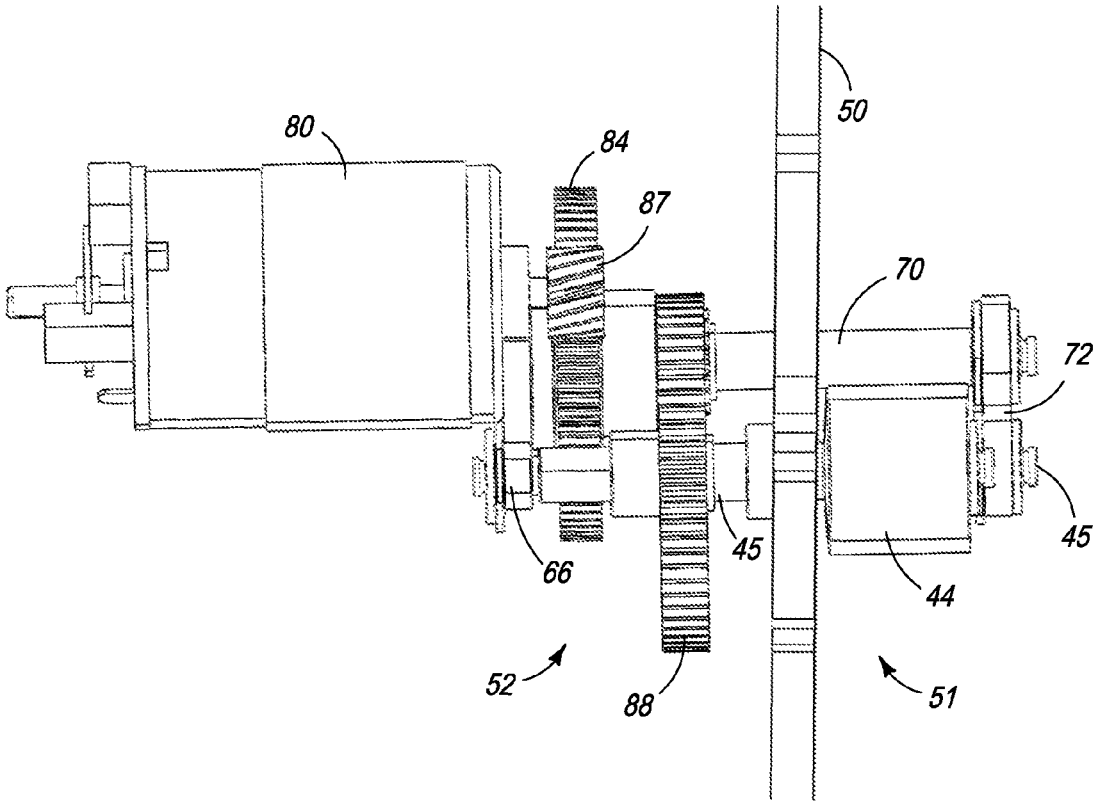
FIG. 3 is a sectional view of the intermediary drive with front and rear plates removed mounted relative to a datum plate.
Figure 4:
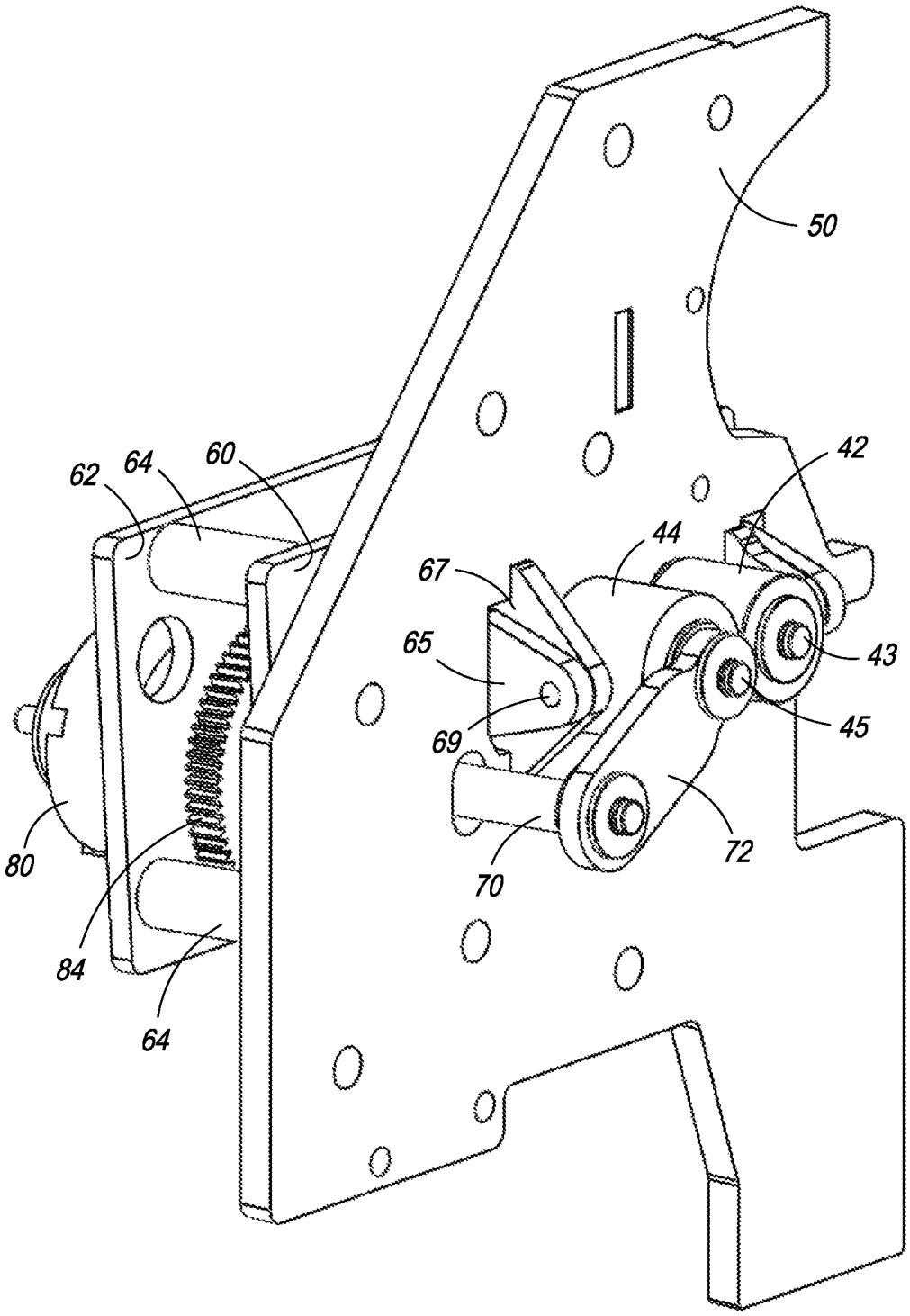
FIG. 4 is a perspective view of the intermediary drive mounted relative to the datum plate.

An intermediary drive roller assembly ("intermediary drive") 40 is positioned in the media path between the picker 12 and the main drive roller 23. Referring now to FIGS. 2 to 4, the intermediary drive 40 comprises an intermediary idler roller 42 mounted on an intermediary idler shaft 43 and an intermediary drive roller 44 having a gripping surface engaged with the intermediary idler roller 42. The intermediary drive roller 44 is mounted on a rotatable intermediary drive shaft 45 extending generally parallel with the intermediary idler shaft 43.

The intermediary drive shaft 45 is freely moveable relative to the intermediary idler shaft 43 to provide a variable distance between the intermediary drive roller 44 and the intermediary idler roller 42. This movement of the intermediary drive shaft provides a regenerative clamping force between the intermediary drive roller 44 and the intermediary idler roller 42 during use, as will be explained in more detail below.

Referring to FIGS. 3 and 4, the intermediary drive 40 is mounted at a tilt angle relative to a datum plate 50 such that the intermediary drive and idler rollers 44 and 42 are both angled towards the datum plate in the media feed direction. The tilt angle is optimized for steering media sheets into a downstream portion of the datum plate 50, where they abut with the datum plate and maneuver into alignment therewith. The tilt angle may be fixed or adjustable. In practice, a tilt angle of about 1-2 degrees (e.g. 1.5 degrees) has been found to provide optimal side justification and de-skewing of paper sheets. The regenerative clamping force of the intermediary drive and idler rollers 44 and 42 provides sufficient grip for steering media sheets onto the datum plate 50, whilst still allowing the necessary rotational (yaw) slippage for side justification of the media sheets. Pitch and roll of the media sheets are controlled via contact with the media guide 16.

Referring back to FIG. 1, the datum plate 50 is mounted perpendicularly with respect to the media path and extends both upstream and downstream of the intermediary drive 40. The datum plate 50 provides lever arms long enough to react the skew alignment moments of the intermediary drive 40 without damaging the side justification edge of the media sheets. Typically, the datum plate 50 extends about 8 to 15 cm upstream and downstream of the intermediary drive 40. Typically, the datum plate 50 extends along at least 60%, at least 70%, at least 80%, or at least 90% of the media path between the media tray 10 and the main drive roller 23.

The features of the intermediary drive roller assembly 40 will now be described in detail with reference to FIGS. 2 to 7. Referring initially to FIG. 2, the intermediary drive roller assembly 40 comprises a front plate 60 and a parallel rear plate 62 separated by a plurality of fixed spacers 64. As shown in FIGS. 3 and 4, the intermediary drive 40 is mounted proximal to the datum plate 50 at a predetermined tilt angle. In prototype embodiments, the intermediary drive roller assembly 40 may be pivotally mounted with respect to the datum plate 50 via mounting arms 65, which are pivotally connected to support arms 67 extending from the datum plate. The pivoting mounting arms 65, having a pivot axis 69 parallel with the datum plate 50, allow the tilt angle of the intermediary drive 40 to be readily adjusted. However, it will be appreciated that in production embodiments, the intermediary drive roller assembly 40 is usually mounted at a fixed optimized tilt angle relative to the datum plate 50. For example, the datum plate 50 and/or the front plate 60 may include suitable mounting features to provide a fixed tilt angle.

The rotatable intermediary drive shaft 45 has a first end received in a drive bearing 66 mounted to the rear plate 62. The intermediary drive shaft 45 extends axially from the drive bearing 66 and through an opening in the front plate 60. The intermediary drive roller 44 is fixedly mounted about an opposite second end of the intermediary drive shaft 45 for rotation therewith. The drive bearing 66 has a clearance which allows a small degree of movement of the intermediary drive shaft 45 towards and away from the intermediary idler shaft 43.

The intermediary idler roller 42 is fixedly mounted on the rotatable intermediary idler shaft 43 for rotation therewith. The intermediary idler shaft 43 extends from the front plate 60 and has one end received in an idler bearing 68, which maintains the intermediary idler shaft in a perpendicular orientation with respect to the front plate 60.

The second end of the intermediary drive shaft 45 is connected to a fixed (i.e. non-rotatable) support shaft 70 via a swing arm 72, which extends parallel with the front plate 60 and perpendicular to the support shaft. The swing arm 72 is pivotally mounted at one end to the support shaft 70 and pivotally mounted at the other end to the intermediary drive shaft 45. The swing arm 72 controls movement of the intermediary drive shaft 45 in an arcuate locus having the support shaft 70 as a pivot axis. The support shaft 70 is positioned upstream of the intermediary drive shaft 45 relative to the media feed direction and at an opposite side of the intermediary drive shaft relative to the intermediary idler shaft 43. This positioning ensures that arcuate movements of the intermediary drive shaft 45, reacting to media drag forces, closes the gap between the intermediary driver roller 44 and the intermediary idler roller 42.

The support shaft 70, the intermediary drive shaft 45 and the intermediary idler shaft 43 are generally parallel and extend perpendicularly with respect to the front plate 60, notwithstanding the small arcuate movements of the intermediary drive shaft 45.

Referring to FIGS. 3 and 4, the datum plate 50 has openings for receiving the support shaft 70, the intermediary drive shaft 45 and the intermediary idler shaft 43 therethrough. As shown in FIG. 3, the swing arm 72, the intermediary drive roller 44 and the intermediary idler roller 42 are positioned at a front side 51 of the datum plate 50, while the front plate 60, rear plate 62 and drive mechanism are positioned behind the datum plate at a rear side 52. It will be appreciated that the support shaft 70, the intermediary drive shaft 45 and the intermediary idler shaft 43 extend non-perpendicularly from the datum plate 50 in order to provide the necessary tilt of the rollers 42 and 44 towards the datum plate.

Figure 5:
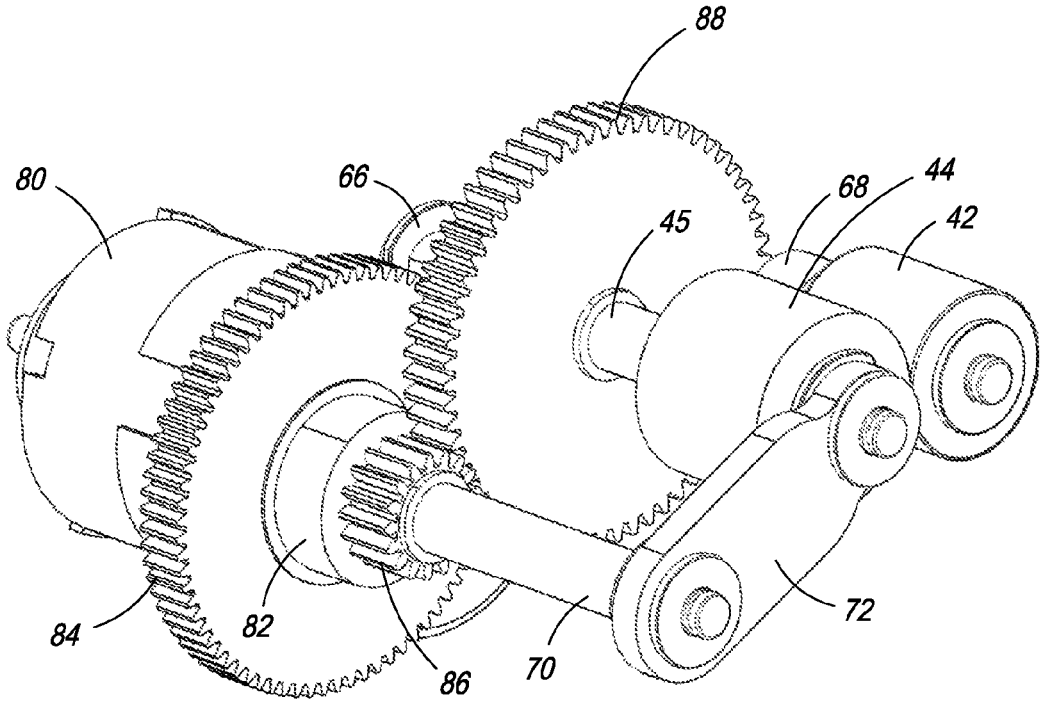
FIG. 5 is a top perspective view of the intermediary drive with front and rear plates removed.
Figure 6:
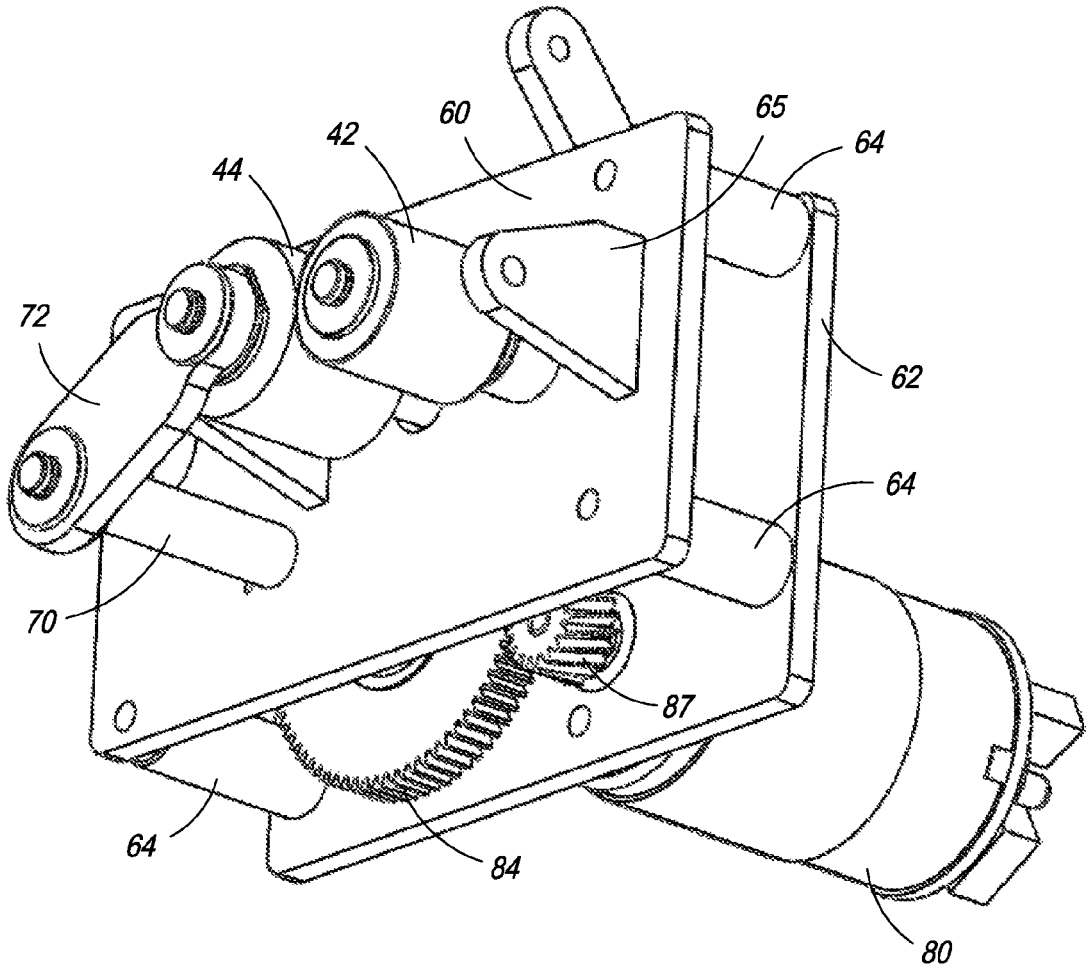
FIG. 6 is a bottom perspective view of the intermediary drive.
Figure 7:
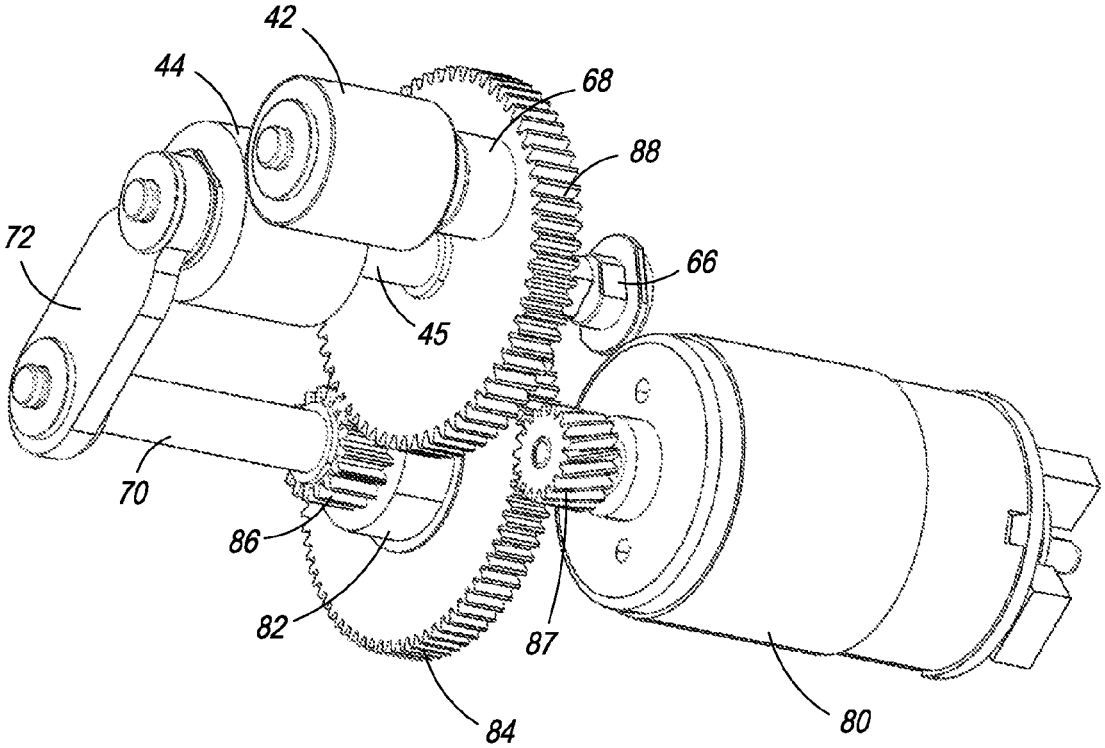
FIG. 7 is a bottom perspective view of the intermediary drive with front and rear plates removed.

Referring to FIGS. 3, 5 and 7, the drive mechanism of the intermediary drive 40 comprises a gear train, which operatively connects a drive motor 80 to the intermediary drive shaft 45. A primary gear 82 comprises a relatively larger drive gear wheel 84 and a relatively smaller first gear wheel 86 as an integrated dual gear assembly. The drive gear wheel 84 and the first gear wheel 86 of the primary gear 82 are coaxially and rotatably mounted about the fixed support shaft 70. The drive gear wheel 84 is driven by intermeshing engagement with a motor pinion 87 of the motor 80.

The first gear wheel 86 intermeshingly engages with a second gear wheel 88 fixedly mounted about the intermediary drive shaft 45. Thus, rotation of the primary gear 82 drives rotation of the second gear wheel 88 and the intermediary drive shaft 45 via the intermeshing first and second gear wheels 86 and 88. The coaxial arrangement of the first gear wheel 86 and the support shaft 70, and the coaxial arrangement of the second gear wheel 88 and the intermediary drive shaft 45 minimizes changes in mesh depth when the intermediary drive shaft arcuately swings towards and away from the intermediary idler shaft 43.

During use, paper is fed generally upwards as shown in FIGS. 2 and 4 by the picker roller 13 and into the nip of the intermediary drive roller 44 and the intermediary idler roller 42. As the paper enters the nip, the swing plate 72 swings arcuately upwards slightly to accommodate the thickness of the paper.

Once the paper has entered the nip, it experiences drag forces in an opposite direction to the paper feed direction due to frictional engagement with the intermediary drive roller 44 as well as frictional engagement with the datum plate 50. The drag forces are transmitted to the swing arm 72, which reacts by swinging arcuately downwards about the pivot axis of the support shaft 70. The downward swing of the swing arm 72 causes the intermediary drive shaft 45 to move arcuately and generally towards the intermediary idler shaft 43. The greater the drag forces, the greater the swing movement of the swing arm 72 and, therefore, the greater the clamping or gripping force between the intermediary drive and idler rollers 44 and 42. In this way, the intermediary drive 40 provides a regenerative clamping force between its rollers.

The tilt of the intermediary drive and idler rollers 44 and 42 steers the paper into the datum plate 50 downstream of the intermediary drive 40 and de-skews any paper skew inherited from the media tray 10 and/or picker 12.

When the leading portion of the paper enters main drive and is gripped by the main drive roller 23, the paper is then pulled through the intermediary drive 40 due to the marginally higher speed and higher clamping force of the main drive. This has the effect of swinging the swing arm 72 upwards as shown in FIGS. 2 and 4, which opens the gap between the intermediary drive roller 44 and the intermediary idler roller 42. Therefore, the hand-off from the intermediary drive 40 to the main drive roller 23 is entirely passive and self-coordinating without requiring any sensors or active control of the spacing between the rollers in the intermediary drive.

Returning to FIG. 1, once the paper has been fed through the print zone 30 and into the output roller assembly 32, the paper may either be fed into an output tray (not shown) for simplex printing, or reversed back through a duplex loop 90 for duplex printing. For duplex printing, the output rollers 32 and main drive roller 23 are reversed, and the paper is fed backwards through the print zone 30. The paper is then passively diverted around the duplex loop 90 and back through the intermediary drive 40. It will be appreciated that the operation of the intermediary drive 40 described above is identical for simplex and duplex printing.

It will, of course, be appreciated that the present invention has been described by way of example only and that modifications of detail may be made within the scope of the invention, which is defined in the accompanying claims.

The invention claimed is:

1. A printer comprising:

a media tray for storing a plurality of media sheets;

a picker for picking individual media sheets from the media tray;

a media guide for guiding the media sheets around a media feed path towards a print zone;

a datum plate mounted perpendicularly with respect to the media feed path for engaging a side edge of each media sheet conveyed around the media guide;

a main drive roller assembly positioned upstream of the print zone; and an intermediary drive roller assembly positioned between the picker and the main drive roller assembly, the intermediary drive roller assembly comprising:

an intermediary idler roller mounted on an intermediary idler shaft; and an intermediary drive roller having a gripping surface engaged with the intermediary idler roller, the intermediary drive roller being mounted on a rotatable intermediary drive shaft, the intermediary drive shaft being operatively connected to a drive mechanism, wherein:

the intermediary drive and idler rollers extend non-perpendicularly relative to the datum plate, the intermediary drive and idler rollers being tilted towards the datum plate in a media feed direction during printing;

the intermediary drive shaft is pivotally connected to a support shaft via a swing arm, such that the intermediary drive shaft is arcuately moveable relative to the intermediary idler shaft; and the media sheets pass through a nip defined between the intermediary idler roller and the intermediary drive roller, the swing arm providing a variable distance therebetween.

2. The printer of claim 1, wherein the intermediary drive shaft, the intermediary idler shaft and the support shaft extend through respective openings in the datum plate.

3. The printer of claim 1, wherein the datum plate extends over at least 80% of a length of the media feed path from the media tray to the drive roller assembly.

4. The printer of claim 1, wherein a first end of the intermediary drive shaft is received in a bearing, the bearing having a clearance allowing arcuate movement of an opposite second end of the intermediary drive shaft.

5. The printer of claim 4, wherein the swing arm pivotally interconnects the second end of the intermediary drive shaft and an end of the support shaft.

6. The printer of claim 1, wherein the support shaft and the intermediary idler shaft are parallel with each other and positioned on opposite sides of the intermediary drive shaft.

7. The printer of claim 1, wherein the support shaft is positioned upstream of the intermediary drive shaft relative to the media feed direction.

8. The printer of claim 1, wherein the drive mechanism comprises a gear train operatively connecting the intermediary drive shaft to an intermediary drive motor.

9. The printer of claim 8, wherein the gear train comprises first and second intermeshed gear wheels, the first gear wheel being coaxial with the support shaft and the second gear wheel being coaxial with the intermediary drive shaft.

10. The printer of claim 1, further comprising a controller configured for operating the intermediary drive roller at a lower speed than a main drive roller of the main drive roller assembly.

11. The printer of claim 10, wherein the controller is configured for operating the intermediary drive roller at a higher speed than a picker roller of the picker.

12. The printer of claim 10, wherein, during use, the main drive roller assembly and the intermediary driver roller assembly are self-coordinating.

13. The printer of claim 1, further comprising a duplexing guide loop, wherein the duplexing guide loop incorporates at least part of the media guide, and wherein the intermediary drive roller assembly is common to a simplex printing path and a duplex printing path.

14. The printer of claim 13, wherein duplexing guide loop is absent any dedicated duplexing drive rollers other than the intermediary drive roller.

* * * * *